US006755443B1

(12) United States Patent
Fresnel

(10) Patent No.: US 6,755,443 B1
(45) Date of Patent: Jun. 29, 2004

(54) PACKAGING ELEMENT WITH PRINTED MARKING, USE THEREOF AND METHOD FOR MAKING SAME

(75) Inventor: Eric Fresnel, Paris (FR)

(73) Assignee: Sleever International Company, Morangis (FR)

( * ) Notice: Subject to any disclaimer, the term of this patent is extended or adjusted under 35 U.S.C. 154(b) by 120 days.

(21) Appl. No.: 10/048,070

(22) PCT Filed: Jul. 3, 2000

(86) PCT No.: PCT/FR00/01881

§ 371 (c)(1),
(2), (4) Date: Jan. 25, 2002

(87) PCT Pub. No.: WO01/08894

PCT Pub. Date: Feb. 8, 2001

(30) Foreign Application Priority Data

Jul. 3, 2000 (FR) ..... 99-09950

(51) Int. Cl.[7] ..... B42D 15/00

(52) U.S. Cl. ..... 283/98; 283/109; 283/94; 283/67

(58) Field of Search ..... 283/67, 72, 84, 283/86, 91, 93, 94, 98, 107, 109, 110, 111, 901; 428/915, 916; 503/217, 219; 427/145, 150

(56) References Cited

U.S. PATENT DOCUMENTS

| | | | | |
|---|---|---|---|---|
| 3,926,645 A | * | 12/1975 | Strahl | 106/31.24 |
| 4,227,719 A | | 10/1980 | McElligott | 283/8 R |
| 5,087,283 A | * | 2/1992 | Dixon et al. | 106/31.2 |
| 6,357,799 B1 | * | 3/2002 | Shibata et al. | 283/91 |
| 6,543,810 B2 | * | 4/2003 | Trantoul | 283/98 |

* cited by examiner

*Primary Examiner*—Willmon Fridie, Jr.
(74) *Attorney, Agent, or Firm*—McCormick, Paulding & Huber LLP

(57) ABSTRACT

The invention relates to a packaging element with printed marking, and in which the wall of the element is made out of plastics material. According to the invention, for a wall that is essentially transparent, the packaging element (10) comprises on one of its faces (11) marking (15) which is printed with sympathetic ink, and said marking (15) is sandwiched between a primary dispersing screen (14) deposited on said face and on which said marking is printed, and a dispersing screen (16) overprinted thereon so as to cover the marking (15) and at least the zone (17) of said face surrounding said marking so as to make the marking undetectable. Such a packaging element can be made in particular in the form of a film, specifically for making heat-shrink packaging sleeves, or in the form of a container, in particular a bottle, a blister, or a box.

15 Claims, 2 Drawing Sheets

PACKAGING ELEMENT WITH PRINTED MARKING, USE THEREOF AND METHOD FOR MAKING SAME

CROSS-REFERENCE TO RELATED APPLICATIONS

This application is entitled to the benefit of and incorporates by reference essential subject matter disclosed in PCT/FR00/01881 filed on Jul. 3, 2000.

BACKGROUND OF THE INVENTION

1. Technical Field

The present invention relates to packaging articles or groups of articles by means of packaging elements having printed marking, with the wall of the element being made of plastics material. The term packaging "element" as used herein should be understood in its broadest sense, covering in particular rigid or semirigid containers (bottles, blisters, boxes) and flexible films, and in particular heat-shrink films.

2. Background Art

The extensive development of distribution circuits is raising more and more problems for packaging professionals in their fight against misappropriation, whether of pharmaceuticals, perfumes, or food products in particular. Major manufacturers often have exclusive distributors, and it has been found that certain distributors sell off a portion of their stock at a substantial discount, thus enabling products to be put back on the market at low prices. This problem is further complicated by goods traveling across national borders where the legal and tax regulations often differ between countries. Such movements naturally tend to destabilize both distributors and manufacturers. In order to counter this practice of so-called "gray" or "parallel" markets, which has been taking on worrying proportions in recent years, it would seem to be essential to develop concepts of product traceability.

Traceability serves to identify a particular product at various points in a unique manner, and considerably facilitates data management. Nevertheless, fraudulent handling of goods makes it necessary to provide markings, and in particular coded markings, that must be as discreet as possible so as to preserve product traceability, and thus avoid any modification or destruction of the packaging. Thus, various reading techniques have been developed, for example using interlaced bar codes ("two out of five") or other codes, or using electronic chips, suitable for being read by an appropriate reader machine which the manufacturer or the distributor possesses. Unfortunately, these codes are generally easily spotted by crooks who can then remove them or tear them off. When use is made of packaging films or containers, or indeed of heat-shrink sleeves made of such films, the code is generally printed on the inside face of the packaging element, i.e. the face that faces towards the article. Nevertheless, a knowledgeable crook can easily cut open a packaging element of plastics material and thus gain access to its inside face in order to alter or erase the printed code.

The technical problem that the invention proposes to solve is that of creating a concept of marking a packaging element of plastics material in such a manner as to avoid the codes used being identified, so as to preserve them from destruction, while nevertheless guaranteeing that the packaged products can be identified and traced.

It might be tempting to use techniques that are already in use on packaging made of paper or card, for example printing codes using sympathetic ink, i.e. a colorless liquid which writes a secret text or an encrypted code that appears only under the action of heat or of a reagent. Such ink is also used in the field of authenticating documents: document U.S. Pat. No. 4,227,719 thus describes a technique for providing protection against photocopying, whereby a warning pattern printed directly on the document is used, and is covered in camouflage printed with ink at a density that is selected to be below the critical threshold of the photocopier, such that any photocopy of the protected document automatically causes the warning pattern to appear on the copy.

Unfortunately, this leads to a difficulty that is not easy to overcome, and that is inherent to depositing sympathetic ink on the face of a wall of plastics material, regardless of whether that wall is rigid, semirigid, or flexible, whereby the ink remains visible to the naked eye, in particular when observed in grazing (or incident) light. Thus, even if the encrypted code cannot be read immediately by the crook, its location can easily be found, and consequently the zone that has received a code printed in sympathetic ink can be destroyed. This difficulty does not arise with paper or card because cellulose fibers provide good absorption of the pigments in sympathetic ink, thus making the printing invisible.

BRIEF SUMMARY OF THE INVENTION

An object of the invention is thus to provide a packaging element with printed marking in which the wall of the element is made of plastics material, which can either be essentially transparent, or else bulk-tinted, and on which the marking is not identifiable, while nevertheless being easy to read by authorized people having appropriate reader means, thus guaranteeing that products can be identified and traced.

According to the invention, when a wall of a packaging element made of plastics material is essentially transparent, this problem is resolved by means of an element having marking printed in sympathetic ink on a face of said wall, said marking being sandwiched between a primary dispersing screen deposited on said face and on which said marking is printed, and an overprinted dispersing screen covering the marking and at least that zone of said face surrounding said marking so as to make the marking undetectable.

Under such circumstances, if the film is examined from the side opposite from the marking, then the primary dispersing screen serves to prevent the marking being identified, even under grazing light, and if it is the other side of the film that is observed, then it is the overprinted dispersing screen which performs the same function of preventing identification.

In an alternative embodiment, for a wall of a packaging element which is made of bulk-tinted plastics material, the packaging element of the invention has marking printed in sympathetic ink on a face of said wall, said marking being sandwiched between said face on which said marking is printed and an overprinted dispersing screen covering said marking and at least that zone of said face which surrounds said marking so as to make the marking undetectable.

Thus, if the zone is examined from its side opposite from the marking, then the opaque nature of the bulk-tinted wall suffices to mark the marking, and if said marking is examined from the other face, then the overprinted dispersing screen avoids the marking being identified, even when examination is performed under grazing light.

Preferably, the dispersing screen is of speckled structure reproducing the structure used for printing the marking. The structure then makes it possible to bury the marking zone making it even more invisible. In particular, the dispersing screen is selected to be random so as to avoid identification by fine analysis of the surface.

It is also advantageous to provide for the marking printed in sympathetic ink to overlap at least in part identification elements that are printed on the same face. This makes it easier to spot any action taken in the marking zone in an attempt to tamper with the identification element, since that would make the product unsellable, for example when the identification elements involve legal requirements giving the origin, name, or composition of the product.

The above result is further improved if provision is made for the sympathetic ink that is used for marking to be revealed only under the action of a chemical reagent that is selected for its irreversible destructive action on the wall of the element. Any attempt at acting on the marking zone has the effect of destroying the corresponding zone of the wall in irreversible manner, and this can be identified immediately, even by a consumer paying only ordinary attention. The protection can be further refined by providing for the chemical reagent to be selected so that its destructive action on the wall of the element is retarded. The destructive action then appears only a long time after the crook has taken action.

In accordance with another advantageous characteristic, the packaging element includes additional marking that can be read under ultraviolet (UV) light, and separate from the marking printed in sympathetic ink. It is then preferable for the additional marking to be printed on the face opposite to that which carries the marking in sympathetic ink.

It is generally advantageous to provide for the face carrying the sympathetic ink marking together with the dispersing screen(s) to be the inside face, i.e. the face that faces the article or the group of articles to be packaged. This obliges the crook to cut through the wall surrounding the packaged article or group of articles in order to take action in an attempt to destroy the markings present on the inside face of said wall.

It is generally advantageous to provide for the sympathetic ink marking to be a code that serves to guarantee identification and traceability of the packaged article or group of articles. The term "code" should be understood herein in its broadest sense, covering the most modern facilities for encrypting data.

The wall of the plastics material packaging element can be rigid or semirigid and can form a container, in particular a bottle, a blister, or a box.

In an alternative embodiment, provision can be made for the wall of the plastics material packaging element to be flexible and to form a packaging film, in particular a mono-oriented heat-shrink film. This is particularly advantageous when such a film is used for making heat-shrink packaging sleeves.

The invention also seeks to protect a heat-shrink packaging sleeve made using a segment of heat-shrink film which is mono-oriented and presents at least one of the above-specified characteristics, the film having two end edges bonded together along a generator line of the sleeve.

The invention also provides a method of manufacturing a packaging film having the above-specified characteristics.

For a plastics material film having a wall that is essentially transparent, the method comprises the following successive steps:

printing a primary dispersing screen on a face of the film;

printing marking in sympathetic ink on said primary screen; and printing a dispersing screen as an overprint on said marking.

For a plastics material film having a bulk-tinted wall, the method comprises the following successive steps:

printing marking in sympathetic ink on a face of the film; and printing a dispersing screen as an overprint on said marking.

BRIEF DESCRIPTION OF THE DRAWINGS

Other characteristic and advantages of the invention will appear more clearly in the light of the following description relating to a particular embodiment, and given with reference to the figures of the accompanying drawings, in which.

DETAILED DESCRIPTION OF THE INVENTION

Figure 1:
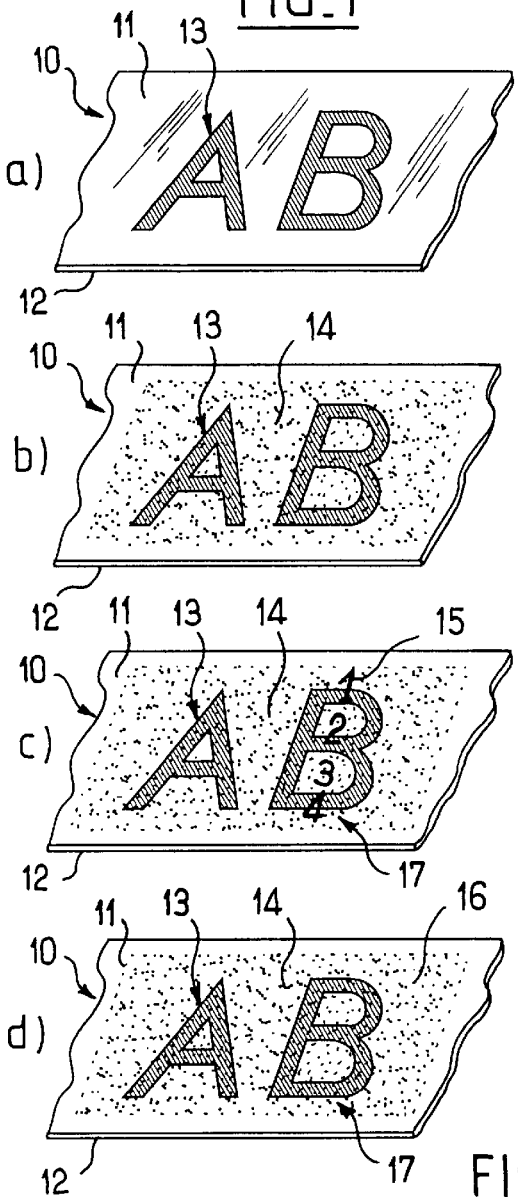
FIG. 1 is a diagram showing how a packaging element is obtained, in this case in the form of a plastics material film having a wall that is transparent and carries invisible marking of sympathetic ink, in accordance with the invention.
Figure 2:
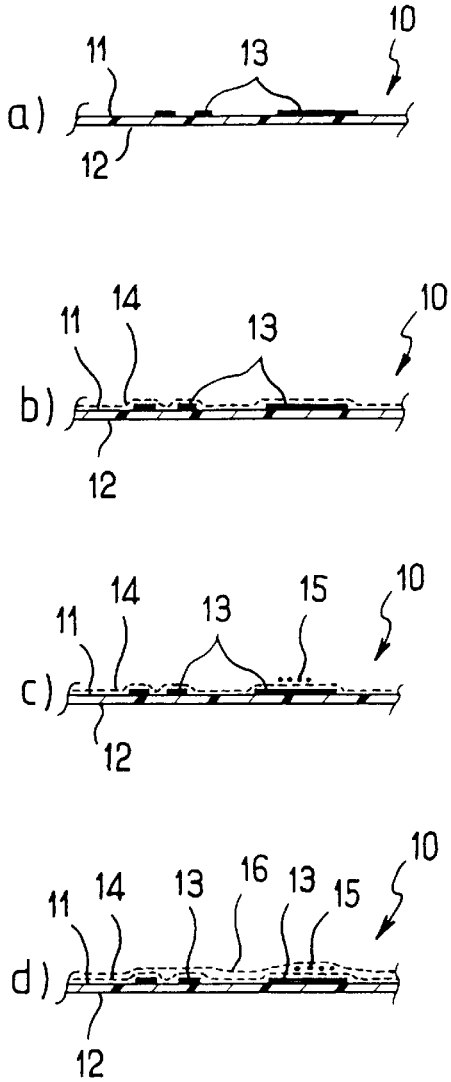
FIG. 2 shows the same steps as FIG. 1, but in diagrammatic section.

In FIGS. 1 and 2, there can be seen a strip of plastics material packaging film 10, and in this case the wall is transparent. The top face of the wall is referenced 11 and its bottom face is referenced 12. By way of example, the material constituting the film can be selected from the materials commonly used in the field of packaging such as polyethylene, polystyrene, polyvinyl chloride, etc. In general, it comprises any rigid or semirigid plastics material suitable for making a box, a blister, or a flexible film.

In step a), the film 10 carries printed identification elements 13 on its face 11, these elements being represented by the letters A and B. This particular packaging film 10 is transparent such that the printed identification elements 13 are easily seen from the opposite face 12, which could be the front face of the film, for example.

In b), a primary dispersing screen 14 is deposited, the structure of the screen being speckled and random. This primary screen 14 is printed, for example, by means of a coating cylinder that is screened, e.g. using a photoengraving technique or any other screen printing technique, not necessarily using cylinders. When a cylinder is used, the peripheral surface of the cylinder is thus engraved with the pattern desired for the random speckled structure. The structure selected for this primary dispersing screen 14 is one that reproduces the structure used subsequently for printing a marking in sympathetic ink, for example a structure using dots, crosses, dashes, etc. Specifically, the diagram shows a primary dispersing screen 14 made in the form of a cloud of small dots.

In c), a marking 15 is printed using sympathetic ink. By way of example, this marking is represented by a sequence of digits 1, 2, 3, 4. Specifically, the sympathetic ink marking 15 is shown as being deposited in such a manner as to overlap the printed identification elements 13, at least in part. This makes it possible to combat more effectively any attempt at tampering seeking to destroy the printed marking, assuming that its position has indeed been identified, since any such tampering would also visibly spoil the printed identification elements 13. These identification elements could be the trademark of the product, or visible elements such as those that are in common use, e.g. legal mentions specifying the origin or the composition of the product. Thus, for pharmaceuticals for example, eliminating any legal mentions or mentions giving the composition of the product would make the product completely unsellable.

It should be observed that the primary dispersing screen 14 is present over the entire zone (referenced 17) of the face 11 of the film surrounding the marking 15.

In d), a dispersing screen 16 is deposited as an overprinting that covers the marking 15 and at least the above-specified zone 17 surrounding said marking, so as to make it invisible. The marking 15 is thus sandwiched between the two dispersing screens 14 and 16.

The Applicant has performed numerous tests before reaching a genuinely effective solution, and in particular has been able to observe that the product obtained at the end of step c), although theoretically appropriate, turns out not to provide effective protection against a crook looking for the marking by intelligent use of grazing light. It is thus depositing the overprinted dispersing screen 16 that causes the presence of the printed marking 15 to become genuinely invisible and undetectable.

The overprinted dispersing screen 16 is likewise of speckled structure so as to reproduce the structure used for printing the marking 15.

Thus, step d) produces a packaging film whose face 11 carries marking 15 printed using sympathetic ink with a dispersing screen 16 overprinted thereon to cover the marking 15 and at least the zone 17 on said face that surrounds said marking, so as to make the marking undetectable. The film is transparent in the zone 17 of its face that surrounds the marking 15 and on said face it also carries the primary dispersing screen 14 onto which the marking 15 is printed, with the combination thereof being covered in turn by the overprinted dispersing screen 16.

In this situation, the marking 15 is thus sandwiched between the primary dispersing screen 14 and the overprinted dispersing screen 16.

Although having a film which is transparent is the circumstance which occurs most frequently in practice, it is also possible to provide packaging films of opaque or opacified type in the zone of the face surrounding the marking, or more generally of the type that is bulk-tinted. Under such circumstances, examining the packaging film from beside the wall of the film does not enable anything to be distinguished, and in particular any marking printed in sympathetic ink. The problem naturally remains when the other face of the film is examined, particularly under grazing light. Under such circumstances, the packaging film has a single overprinted dispersing screen 16 without any primary dispersing screen.

The marking 15 is then sandwiched between the face on which said marking is printed and the overprinted dispersing screen 16.

Figure 3:
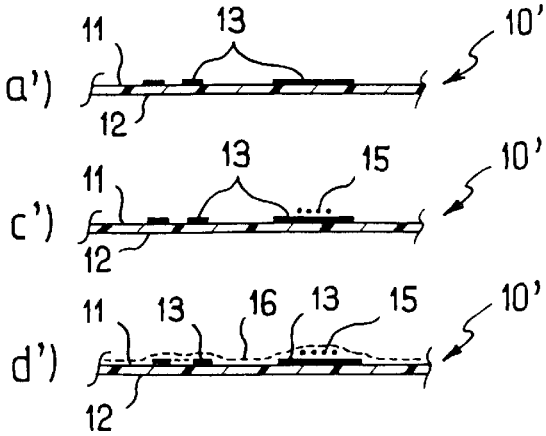
FIG. 3 is a diagrammatic view analogous to that of FIG. 2, but for the case when a plastics material film is used whose wall is bulk-tinted.

This is represented by FIG. 3 where above-described steps a), b), c), and d) that apply to a transparent packaging film are replaced by steps a'), c'), d') which are analogous to the steps a), c), and d).

In a'), the packaging film referenced 10' receives printed identification elements 13, and then in step c') it receives marking 15 printed in sympathetic ink. Finally, in step d') the overprinted dispersing screen 16 is deposited and then becomes the sole screen to be used. Under such circumstances, it is this overprinted screen 16 which makes it impossible to locate the printed marking 15 when examining the printed face, even when such examination is performed under grazing light.

As mentioned above, it is advantageous for the marking 15 printed in sympathetic ink to overlap at least in part the printed identification elements 13. This is naturally not essential, but it does serve to further complicate the task of a crook by making it practically impossible to preserve the identification elements while carrying out destruction work in the zone of the printed marking.

The protection provided is further improved if provision is made for the sympathetic ink that is used for the marking 15 to appear only under the action of a particular chemical reagent selected to have irreversible destructive action on the film. This can be done with solvated type developers, e.g. ketones or esters. As will readily be understood, if a crook seeks to decrypt the printed marking by using the appropriate chemical developer, then the wall of the film will automatically present irreversible traces of destruction, of a kind that can immediately be seen subsequently, even by a consumer of only ordinary attention. This security can be further improved by providing for the chemical reagent to be selected so that its destructive action on the film is retarded. The crook cannot foresee that the solvent will continue to act on the material from which the film is made so as to give rise to irreversible traces of destruction that will not appear until long after the crook has acted on the marking.

Naturally, different sympathetic inks can be provided so that each co-operates with a chemical developer that is dedicated to each application. Only the recipient knows where the marking is located and which is the right developer to use, and therefore it is only the recipient who can decrypt the marking printed in sympathetic ink.

Figure 4:
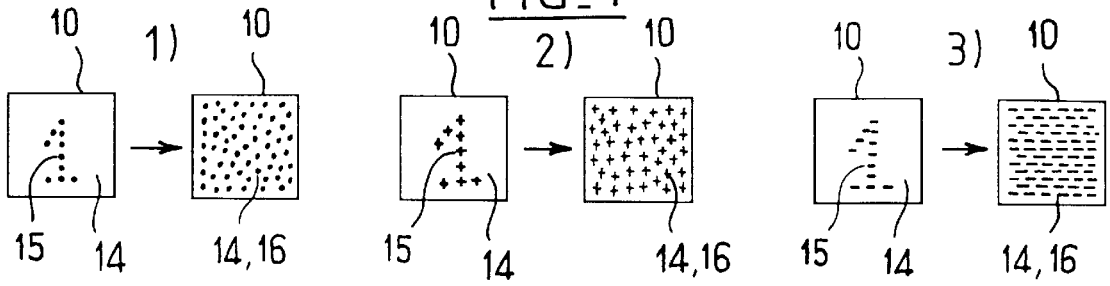
FIG. 4 shows various types of structure used for printing the marking, and then reused for making the speckled structure that constitutes the dispersing screen(s)

FIG. 4 is a diagram showing the visible effect of the structures used for printing the marking 15 and the dispersing screen(s) 14, 16.

In 1), the printed marking 15, in this case representing the digit 1, is printed as a succession of small dots. If the film in use 10 is transparent, then the face concerned is previously coated in a primary dispersing screen 14 likewise made up of a speckled structure of small dots. Since this structure is preferably random, visually identifying the marking, even when using sophisticated analysis means, becomes even more complicated. Specifically, the primary screen 14 is not shown so as to make it possible to see the digit of the marking 15. After the dispersing screen 16 has been deposited by being overprinted, the cloud of small dots makes it completely impossible to locate the digit 1 previously printed using sympathetic ink, even by examination using grazing light.

The same phenomenon is also shown at 2) and at 3) respectively for a structure using sequences of crosses and for a structure using sequences of dashes. These are merely examples, and it is possible to use any other kind of structure that can be envisaged with present-day printing means.

It is also possible to provide for the packaging film to include additional marking that can be read under ultraviolet (UV) light, and which is separate from the marking 15 printed in sympathetic ink. This additional marking is preferably printed on the face opposite to the face carrying the marking 15 in sympathetic ink. Using such additional marking further complicates the task of the crook, who must also take action using appropriate reader means to spoil the other marking. In any event, even if the crook manages to vary the UV marking in a larger zone making it impossible to recognize and read this marking, e.g. by depositing varnish or some other suitable chemical, the marking in sympathetic ink will remain and cannot be detected because of the use of one or two dispersing screens.

Figure 5:
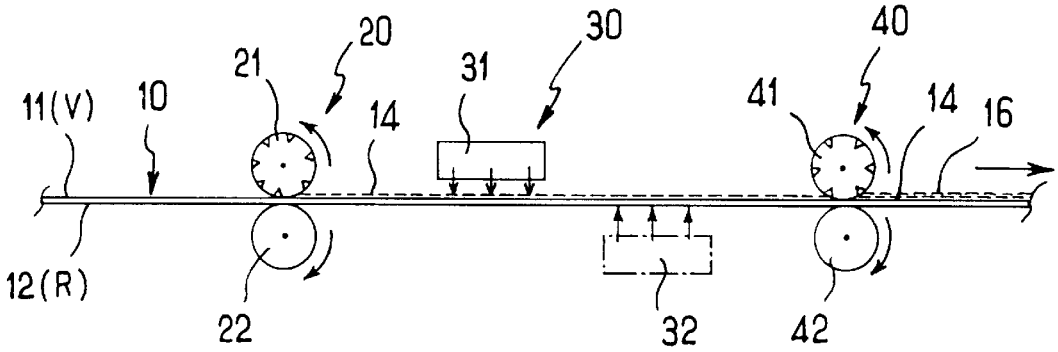
FIG. 5 is a diagrammatic view showing an installation implementing a method of manufacturing a packaging film having a transparent wall with invisible marking of sympathetic ink in accordance with the invention, optionally together with additional marking that can be read under UV light.

FIG. 5 shows a method of making a packaging film in accordance with the invention. This figure is naturally highly diagrammatic, seeking only to show the successive operations performed on the film.

The film 10, possibly already printed, e.g. with the above-mentioned printed elements, is in this case of the transparent type. The film 10 passes firstly through a station 20 corresponding to printing the-primary dispersing screen 14. For this purpose, it passes between two rollers 21 and 22, where the roller 21 is a screened cylinder whose screen is preferably insulated to have the same structure as those used subsequently for printing the marking. Although any color could be used, it is preferable to use a gray or black color as is already used for printing the printed elements. The film 10 then comes to a station 30 where the marking is printed in sympathetic ink. The apparatus used is represented by rectangle 31. It should be observed that the sympathetic ink marking is printed in this case on the face 11 or verso face (V) of the film, i.e. the same face as has already been printed with the primary dispersing screen 14. Optionally, provision can be made for apparatus 32 that serves to print UV marking (for longwave or shortwave UV radiation, as appropriate), in this case on the face 12 opposite from the face carrying the marking printed in sympathetic ink, i.e. on the recto face (R) of the film. Finally, the film 10 passes through a station 40 where the overprinted dispersing screen 16 is printed. The film 10 thus passes between two rollers 41 and 42 and the roller 41 is a screened cylinder analogous to the cylinder 21 used in the station 20. This deposition of the dispersing screen 16 as overprinting is fundamental since it is this which enables the marking made using sympathetic ink to be sandwiched and thus made undetectable.

Figure 6:
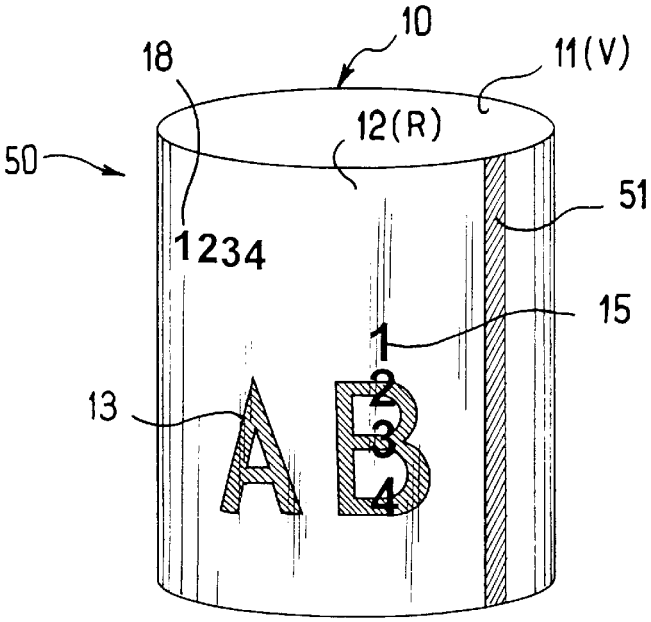
FIG. 6 is a perspective view showing a heat-shrink packaging sleeve made from a segment of film of the above-specified type, in accordance with the invention.

As mentioned above, the packaging film can be a heat-shrink film which is mono-oriented. This is particularly advantageous when such a film is used for making heat-shrink packaging sleeves. FIG. 6 shows such a heat-shrink packaging sleeve which is described in greater detail below.

In FIG. 6, there can thus be seen a heat-shrink sleeve 50 made from a segment of film 10 or 10' carrying the above-mentioned screens and prints, and having two end edges bonded together along a generator line of the sleeve, at a bonding line referenced 51. On the outside face 12 of the sleeve, there can be seen a UV marking 18, represented in this case by the digits 1, 2, 3, 4. On the inside face 11 of the sleeve, there can be seen printed identification elements 13, represented here by the letters A and B, as before, and also the presence of marking in sympathetic ink, likewise represented by the digits 1, 2, 3, and 4. The same encrypted code is thus used for the marking 15 in sympathetic ink and for the UV marking 18. The figure corresponds to the situation that would be obtained after using appropriate developer enabling the marking 15 that is printed in sympathetic ink to be read. FIG. 6 does not show the dispersing screens 14 and 16 between which the sympathetic ink marking 15 is sandwiched.

Specifically, the film constituting the sleeve 50 carrying the sympathetic ink marking 15 and the dispersing screens 14 and 16 is totally transparent. Naturally, provision could be made for the face 11 of said sleeve carrying the sympathetic ink marking 15 and a single overprinted dispersing screen 16 to be bulk-tinted, in which case only one dispersing screen is used (which is overprinted on the sympathetic ink marking).

The sympathetic ink marking 15 is preferably a code serving to guarantee identification and traceability of the packaged article or group of articles. The recipient has the appropriate developer, and knows where the code printed in sympathetic ink is located: this makes it easy to read the code.

This provides a structure for a packaging film or heat-shrink packaging sleeve that carries coding in sympathetic ink which is not only made invisible because of the nature of the ink, but also undetectable because of the use of at least one dispersing screen. The resulting security thus reaches a very high level, particularly if an ink is used which appears only under the action of a chemical reagent selected for its irreversible destructive action on the film.

The above description naturally applies in the same manner to circumstances in which the plastics material packaging element is not a flexible film, but has a wall that is rigid or semirigid, so as to form a container, in particular a bottle, a blister, or a box. Under such circumstances also, the same basic concept of sandwiching marking in sympathetic ink is used, with the marking being sandwiched either between two dispersing screens if the wall is transparent, or between the printed face and an overprinted dispersing screen if the wall is bulktinted.

The invention is not limited to the embodiment described above, but on the contrary covers any variant using equivalent means to reproduce the essential characteristics specified above.

For example, provision can be made for the UV marking also to be sandwiched like the marking in sympathetic ink, since that does not affect its flexibility.

What is claimed is:

1. A packaging element with printed marking, the wall of the element being made of an essentially transparent plastics material, and the element being characterized in that, on one face (11) of said wall, it carries marking (15) printed in sympathetic ink, said marking (15) being sandwiched between a primary dispersing screen (14) disposed on said face and on which said marking is printed, and an overprinted dispersing screen (16) covering the marking (15) and at least that zone (17) of said face surrounding said marking, so as to make the marking undetectable.

2. A packaging element with printed marking, in which the wall of the element is made of a plastics material that is bulk-tinted, the element carrying, on a face of said wall, marking printed in sympathetic ink, said marking being sandwiched between said face on which said marking is printed, and an overprinted dispersing screen covering the marking and at least that zone of said face which surrounds said marking, so as to make the marking undetectable.

3. A packaging element according to claim 2, wherein the or each dispersing screen is of speckled structure reproducing the structure used for printing the marking.

4. A packaging element according to claim 3, wherein the or each dispersing screen is random.

5. A packaging element according to claim 2, wherein the marking printed with sympathetic ink overlaps at least in part identification elements printed on the same face.

6. A packaging element according to claim 5, wherein the sympathetic ink used for the marking appears only under the action of a chemical reagent selected to have irreversible destructive action on the wall of the element.

7. A packaging element according to claim 6, wherein the chemical reagent is selected to have destructive action on the wall of the element that is retarded.

8. A packaging element according to claim 2, having additional marking readable under UV light, and separate from the marking printed in sympathetic ink.

9. A packaging element according to claim 8, wherein the additional marking is printed on the opposite face to the face carrying the marking in sympathetic ink.

10. A packaging element according to claim 2, wherein the face carrying the marking in sympathetic ink and the dispersing screen(s) is the inside face, i.e. the face which faces towards the article or group of articles to be packaged.

11. A packaging element according to claim 2, wherein the marking in sympathetic ink is coding serving to guarantee traceability for the packaged article or group of articles.

12. A packaging element according to claim 2, wherein the wall of said element is rigid or semirigid, forming a container, in particular a bottle, a blister, or a box.

13. A packaging element according to claim 2, wherein the wall of said element is flexible, and forms a packaging film, in particular a mono-oriented heat-shrink film.

14. A heat-shrink packaging sleeve, wherein the sleeve is made from a segment of film according to claim 13, the two end edges of the film being bonded together along a generator line of said sleeve.

15. A method of manufacturing a packaging film according to claim 13, the method comprising the following successive steps:

printing marking in sympathetic ink on a face of the film; and printing a dispersing screen as an overprint on said marking.

* * * * *

UNITED STATES PATENT AND TRADEMARK OFFICE

CERTIFICATE OF CORRECTION

PATENT NO. : 6,755,443 B1
DATED : June 29, 2004
INVENTOR(S) : Eric Fresnel

It is certified that error appears in the above-identified patent and that said Letters Patent is hereby corrected as shown below:

Columns 8, 9 and 10,
Please delete claims 3-15, and replace with following allowed claims 3-15:

3. A packaging element according to claim 1, wherein the or each dispersing screen is of speckled structure reproducing the structure used for printing the marking.

4. A packaging element according to claim 3, wherein the or each dispersing screen is random.

5. A packaging element according to claim 1, wherein the marking printed with sympathetic ink overlaps at least in part identification elements printed on the same face.

6. A packaging element according to claim 5, wherein the sympathetic ink used for the marking appears only under the action of a chemical reagent selected to have irreversible destructive action on the wall of the element.

7. A packaging element according to claim 6, wherein the chemical reagent is selected to have destructive action on the wall of the element that is retarded.

8. A packaging element according to claim 1, having additional marking (18) readable under UV light, and separate from the marking printed in sympathetic ink.

9. A packaging element according to claim 8, wherein the additional marking is printed on the opposite face to the face carrying the marking in sympathetic ink.

10. A packaging element according to claim 1, wherein the face carrying the marking in sympathetic ink and the dispersing screen(s) is the inside face, i.e. the face which faces towards the article or group of articles to be packaged.

11. A packaging element according to claim 1, wherein the marking in sympathetic ink is coding serving to guarantee traceability for the packaged article or group of articles.

12. A packaging element according to claim 1, wherein the wall of said element is rigid or semirigid, forming a container, in particular a bottle, a blister, or a box.

13. A packaging element according to claim 1, wherein the wall of said element is flexible, and forms a packaging film, in particular a mono-oriented heat-shrink film.

14. A heat-shrink packaging sleeve, wherein the sleeve is made from a segment of film according to claim 13, the two end edges of the film being bonded together along a generator line of said sleeve.

UNITED STATES PATENT AND TRADEMARK OFFICE

CERTIFICATE OF CORRECTION

PATENT NO. : 6,755,443 B1
DATED : June 29, 2004
INVENTOR(S) : Eric Fresnel

It is certified that error appears in the above-identified patent and that said Letters Patent is hereby corrected as shown below:

Columns 8, 9 and 10 cont'd.,

15. A method of manufacturing a packaging film according to claim 13, the method comprising the following successive steps:
- printing a primary dispersing screen on a face of the film ;
- printing marking in sympathetic ink on said primary screen ; and
- printing a dispersing screen as an overprint on said marking.

Signed and Sealed this

Nineteenth Day of October, 2004

JON W. DUDAS
*Director of the United States Patent and Trademark Office*